US005467880A

United States Patent [19]

Etoh et al.

[11] Patent Number: 5,467,880

[45] Date of Patent: Nov. 21, 1995

[54] TAMPER-REVEALING SCREW-CAP FOR A CONTAINER

[75] Inventors: Makoto Etoh; Kiyoshi Kawaguchi, both of Kanagawa, Japan

[73] Assignee: Toyo Seikan Kaisha, Ltd., Tokyo, Japan

[21] Appl. No.: 189,934

[22] Filed: Feb. 1, 1994

[30] Foreign Application Priority Data

Oct. 27, 1993 [JP] Japan ..... 5-302152

[51] Int. Cl.[6] ..... B65D 41/34

[52] U.S. Cl. ..... 215/256; 215/254; 215/250; 220/266

[58] Field of Search ..... 215/232, 250, 215/254, 256, 258, 330; 220/214, 359, 266

[56] References Cited

U.S. PATENT DOCUMENTS

| | | | |
|---|---|---|---|
| 2,043,226 | 6/1936 | Beider et al. | 215/232 X |
| 3,901,403 | 8/1975 | Menke | 215/254 X |
| 4,394,917 | 7/1983 | Looser | 215/232 |
| 4,573,582 | 3/1986 | Kusz | 215/232 X |
| 5,012,946 | 5/1991 | McCarthy | 220/359 X |
| 5,111,947 | 5/1992 | Patierson | 215/254 X |

*Primary Examiner*—Allan N. Shoap
*Assistant Examiner*—Nathan J. Newhouse
*Attorney, Agent, or Firm*—Mark Catan; Thomas R. Morrison

[57] ABSTRACT

A safety screw cap indicates prior opening of a container to protect consumers from prior contamination. The screw cap has an annular band encircling its lower end which is separated from the screw cap by a perforated line. The band is affixed to a fixing clement and the fixing element attached to the container when the screw cap is screwed in place. An unattached leader portion of the band can be lifted easily to peel the band from the container. As the band is peeled from the container, it is simultaneously tom from the screw cap at the perforations. Once the band is removed, the screw cap can be unscrewed and the container unsealed. Before peeling the band away, the screw cap cannot be unscrewed without causing obvious damage to the screw cap or band. In addition, the torque required to shear-separate the band from the fixing element, the fixing element from the container or the screw cap from the band is greater than that which can be applied easily by a normal adult.

23 Claims, 5 Drawing Sheets

TAMPER-REVEALING SCREW-CAP FOR A CONTAINER

BACKGROUND OF THE INVENTION

The present invention relates generally to screw top containers and specifically to such devices which reveal a prior opening by requring an alteration in their appearance when they are opened.

It is relatively easy to open and reseal a screw-cap container. This presents a potential hazard to purchasers because such containers can be opened and resealed by someone other than the purchaser. Thus, container contents may be exposed and contaminated without the purchaser being aware of it. To eliminate the danger of such unapparent prior contamination of container contents, various devices have been implemented which permit a consumer to verify that a container has not been opened before the consumer purchases the product.

One example is a screw cap that has a band with inward projections at the opening of the cap. When the cap is screwed onto a container, the projections on the band engage a protrusion on the container. The band breaks away from the cap at a perforated line when the cap is screwed off. Once opened, the cap and band cannot be restored to their original condition. However, the broken band only indicates a removal of the cap. Since it is necessary for the cap to lifted away from the bottle to break the cap from the band at the perforated line, any vacuum inside the container may be broken before the band breaks away. Therefore, it is virtually impossible to determine, upon quick inspection, if the vacuum has been broken without removing the cap. Since contaminants can enter once the vacuum breaks, this type of container sealing mechanism can provide no assurance that container contents are free of exposure to contaminants.

Another problem with the above device is that it may be unsuitable for a large-mouth container. If the above device were applied to large-mouth container, the band portion would need to be unduly large and sturdy. The band must be sturdy to transmit torque applied to the cap via the projection on the band to the protrusion on the cap. Therefore, an excessive force would then be required to break the connection between the band and the cap and thereby open the container. Thus, this type of cap is unsuitable for a large-mouth container.

Another type of tamper-revealing cap has an extended band portion which is heat-shrank to cover the container tightly. The tight fit prevents the band from rotating when the cap is rotated. The band has a perforated line which is torn when the cap is unscrewed. A large amount of torque must be generated to remove such a cap, however. This limits its utility, especially as applied to large-mouth containers.

Still another type of seal includes a ratchet mechanism on the lower end of a cap which is separated from the cap by a perforated line. The same problem of very high torque arises with this design as well.

In still another design, a label is affixed over a cap and a container body. However, since the label is easy to remove, there is a great danger that the label would be intentionally removed and reaffixed after the container is opened.

OBJECTS AND SUMMARY OF THE INVENTION

It is an object of the present invention to provide a safety cap for a container that overcomes the drawbacks of the prior art.

It is another object of the present invention to provide a safety cap for a container that indicates a prior opening.

It is still another object of the present invention to provide a safety cap for a container which is easy to open.

It is still another object of the present invention to provide a safety cap for a container that protects consumers against contamination of container contents.

It is still another object of the present invention to provide a safety cap for a container that can be replaced after opening.

Briefly stated, the present invention provides a safety screw cap that indicates prior opening of a container to protect consumers from prior contamination. The screw cap has an annular band encircling its lower end which is separated from the screw cap by a perforated line. The band is affixed to a fixing element and the fixing element attached to the container when the screw cap is screwed in place. An unattached leader portion of the band can be lifted easily to peel the band from the container. As the band is peeled from the container, it is simultaneously torn from the screw cap at the perforations. Once the band is removed, the screw cap can be unscrewed and the container unsealed. Before peeling the band away, the screw cap cannot be unscrewed without causing obvious damage to the screw cap or band. In addition, the torque required to shear-separate the band from the fixing element, the fixing element from the container or the screw cap from the band is greater than that which can be applied easily by a normal adult.

According to an embodiment of the present invention, there is provided, a tamper-revealing container, comprising: a screw cap having first threads, a container body having a wall and a mouth, the mouth having second threads shaped to thread with the first threads, the screw cap being threaded on the container body, an annular band attached to a lower end of the screw cap, a fixing element, means for attaching the fixing element to the annular band, means for resisting a rotation of the fixing element relative to the container body, the means for resisting having a shear strength characterized by a first torque, the first torque being a minimum torque applied to the fixing element to defeat the means for resisting and means for peeling the annular band and the fixing element from the screw cap and the wall.

According to another embodiment of the present invention, there is provided, a tamper-revealing container, comprising: a container body having a mouth, a screw cap having a diameter, the screw cap being screwed onto the container body, an annular band attached to a lower end of the screw cap, the annular band having a lower portion and an upper portion, the annular band having a dividing region, the dividing region having means for permitting the lower portion to be torn from the upper portion when a peeling force is applied to the lower portion, the means for permitting including a portion of the annular band which is weaker than a remainder of the annular band, the dividing region being between the upper portion and the lower portion, a fixing element, a first bond means for impermanently attaching the fixing element to the container body at the mouth, the first bond means having a first shear strength defined by a first torque, the first torque being a first minimum torque required to shear-separate the fixing element from the container body by rotating the fixing element relative to the container body, a second bond means for attaching the fixing element to the annular band, the second bond means having a second shear strength defined by a second torque, the second torque being a second minimum torque required to shear-separate the fixing element from the annular band by rotating the annular band relative to the fixing element, the dividing region having a third shear strength defined by a third torque, the third torque being a third minimum torque required to break the annular band at the dividing region by rotating the screw cap relative to the lower portion, a fourth torque, in Newton·centimeters, being proportional to a square of the diameter in centimeters, the first torque being substantially greater than the fourth torque, the second torque being substantially greater than the fourth torque and the third torque being substantially greater than the fourth torque.

According to still another embodiment of the present invention, there is provided, a tamper-revealing container, comprising: a screw cap, a container body, the screw cap being screwed onto the container body, the screw cap having an integral band around a perimeter of the screw cap, means for detaching the band from the screw cap, a fixing element, first adhesive means for attaching the fixing element to the band, second adhesive means for attaching the fixing element to the container body, the means for detaching including means for resisting a rotation of the screw cap relative to the container body and a first rotational force required to overcome the means for resisting being greater than a second rotational force manually applicable by a normal adult.

According to still another embodiment of the present invention, there is provided, a tamper-revealing container, comprising: a screw cap, a container body, the screw cap being screwed onto the container body, the screw cap having a band around a perimeter of the screw cap, the screw cap having a diameter, means for detaching the band from the screw cap, a fixing element, first adhesive means for attaching the fixing element to the band, second adhesive means for attaching the fixing element to the container body, the means for detaching including means for resisting a rotation of the screw cap and a torque, in Newton·centimeters, required to overcome the means for resisting, being substantially greater in magnitude than a square of the diameter in centimeters. The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
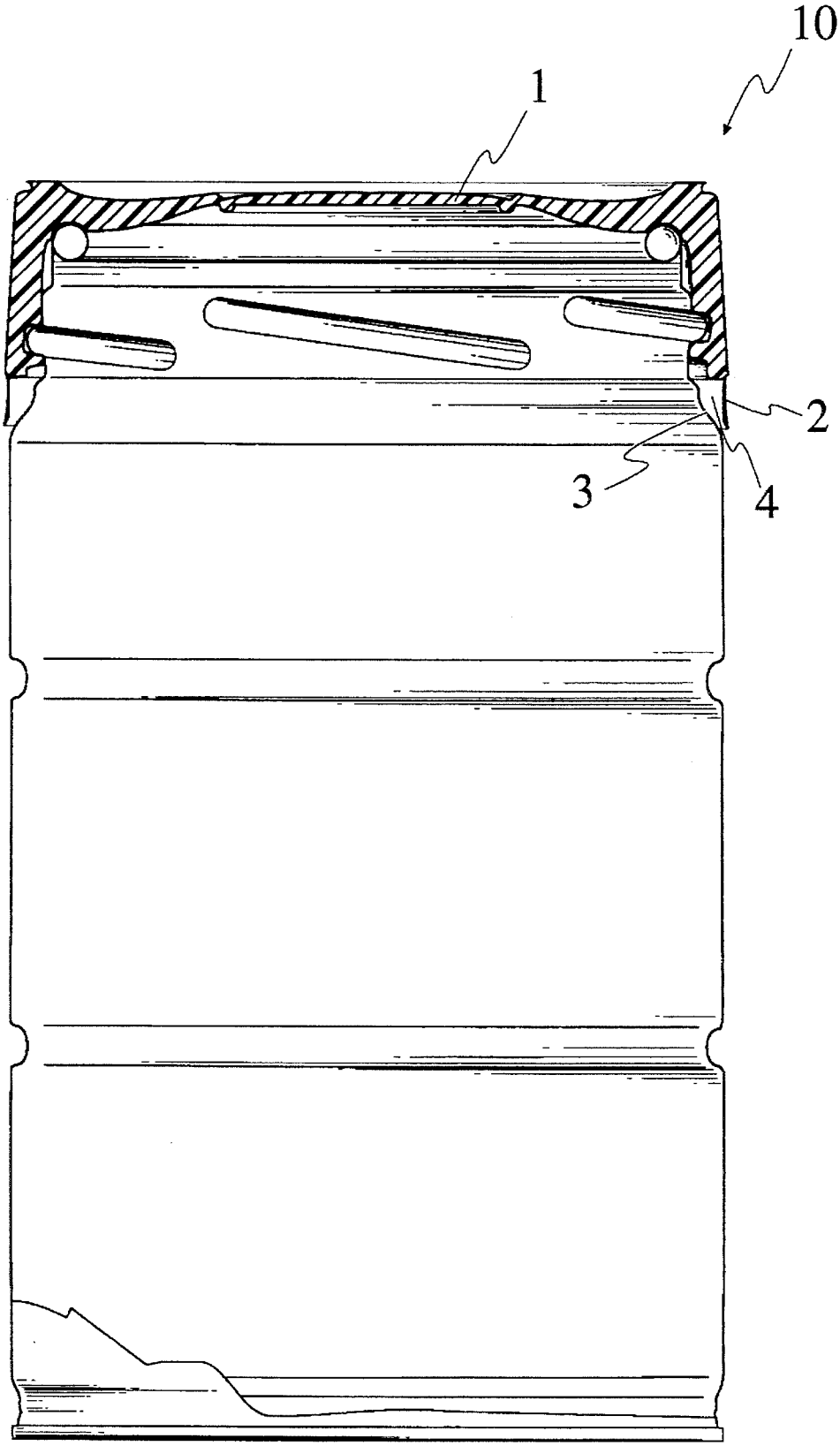
FIG. 1 is a front view of a screw cap according to an embodiment of the present invention.
Figure 5:
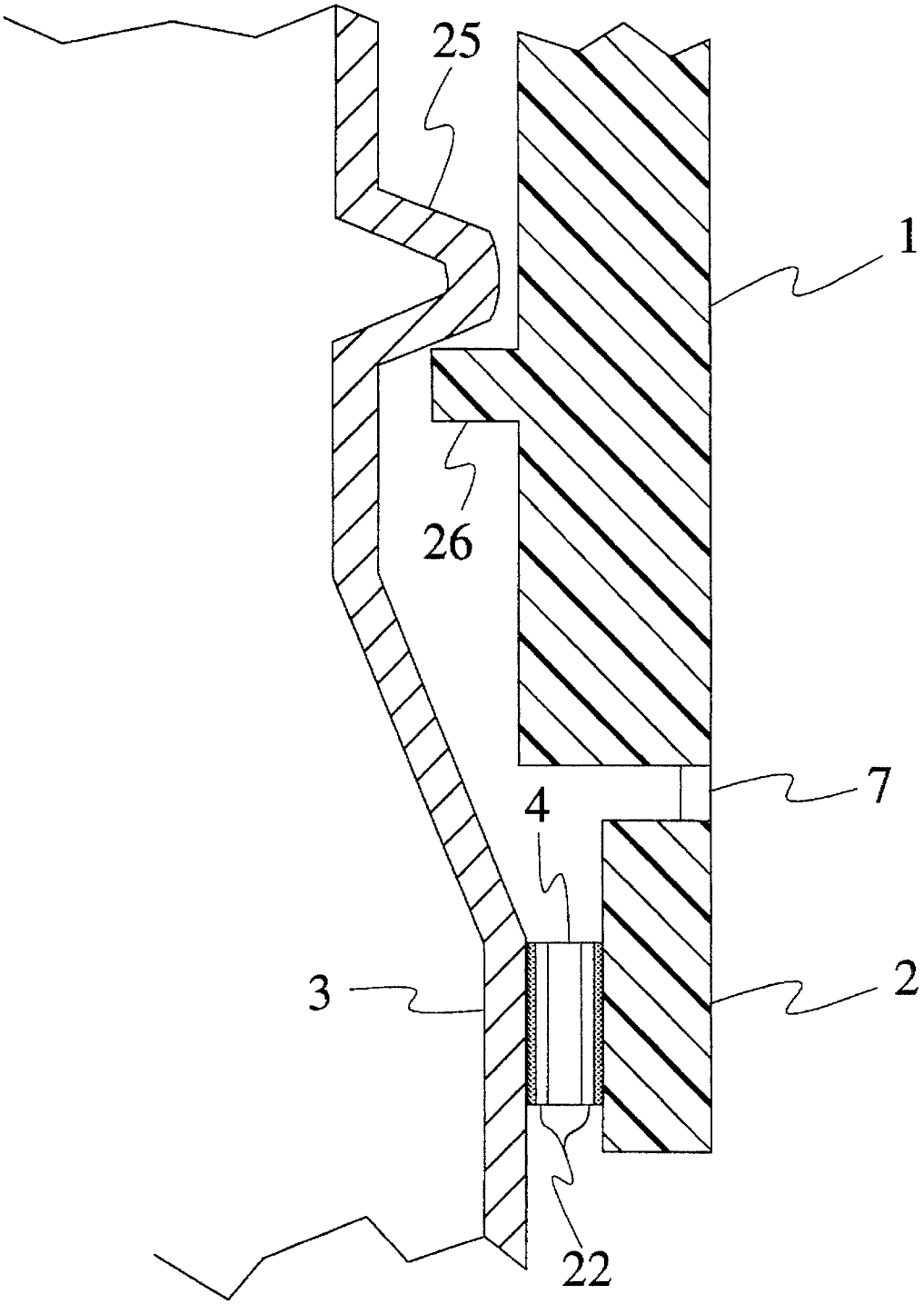
FIG. 5 is a cross-section view of a portion of the screw cap of FIG. 1 screwed on a container body according to another embodiment of the invention.
Figure 6:
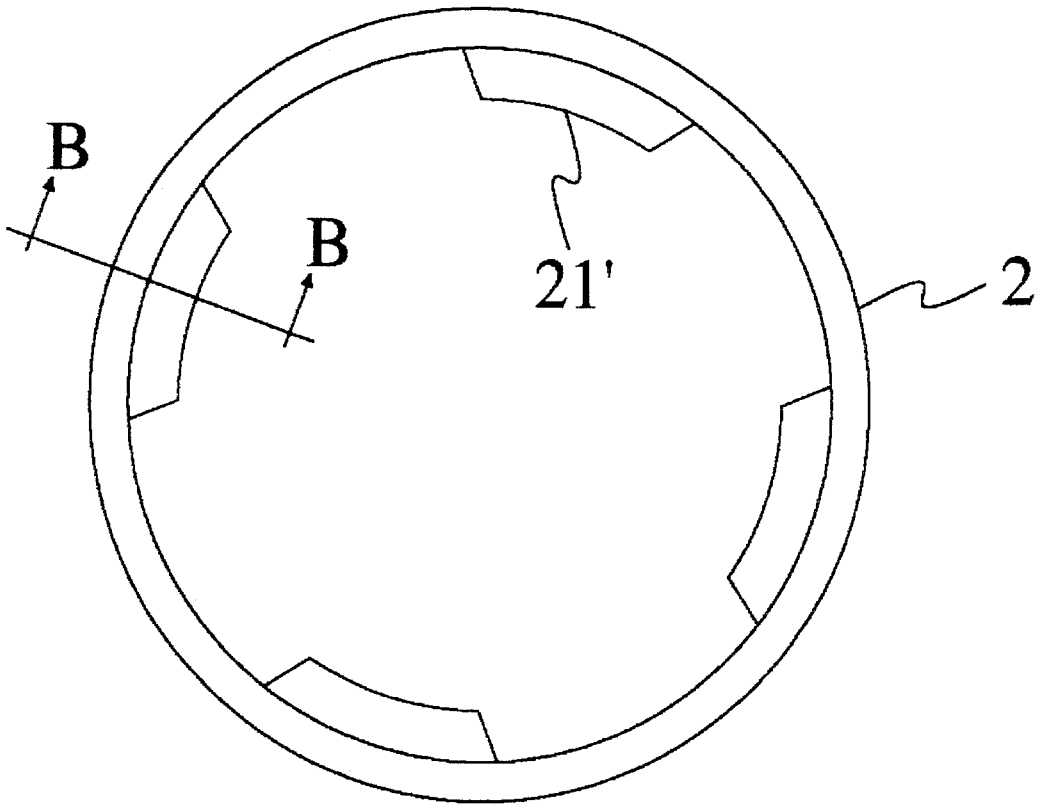
FIG. 6 is a view from underneath the screw cap of the present invention according to the embodiment of FIG. 4.

Referring to FIGS. 1 and 5, a container 10 includes a container body 3 with thread 25 covered by a screw cap 1 with thread 26. An annular band 2 is connected to a lower end of screw cap 1. In the embodiment shown, annular band 2 is contiguous with, and extends from a rim of screw cap 1. A fixing element 4 is adhesively attached by adhesive layers 22, 22, to annular band 2 and container body 3. Fixing element 4 connects container body 3 to annular band 2.

Figure 2:
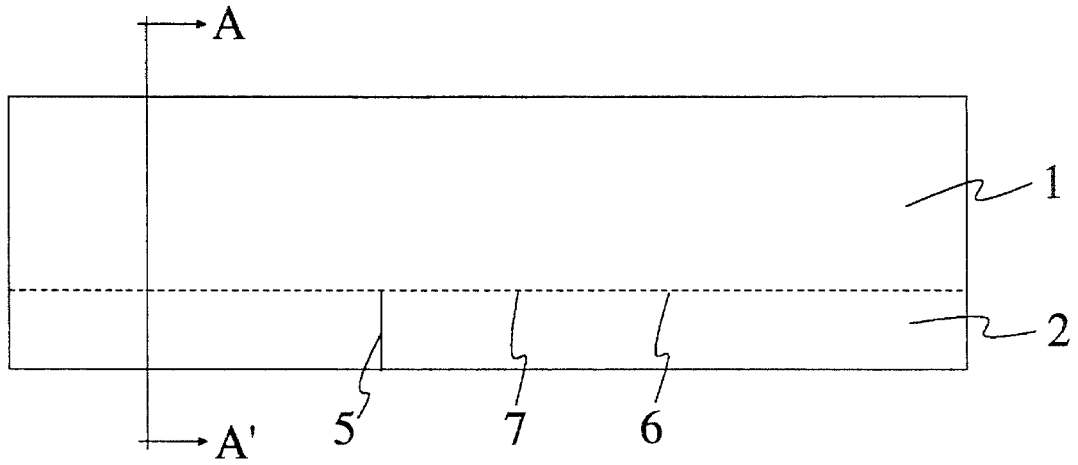
FIG. 2 is an enlarged view of a band of the screw cap of FIG. 1.

Referring now also to FIG. 2, annular band 2 is separated from the lower end of screw cap 1 by a break-line 6 which includes a series of perforations 7. Annular band 2 has a weakened end portion 5 for peeling annular band 2 from container body 3. In the current embodiment, weakened end portion 5 includes another series of perforations, or a break, running across annular band 2. In addition, weakened end portion 5 is not connected to container body 3. Thus, weakened end portion 5 of annular band 2 may be lifted away from container body 3 to be gripped. Weakened end portion 5 may then be pulled and annular band 2 peeled from container body 3. As annular band 2 is peeled, annular band 2 is simultaneously torn from screw cap 1 at break-line 6 with the help of series of perforations 7. Note that various devices for permitting the detachment of annular band 2 from screw cap 1 may be employed. Concentric series of perforations 7 is only one example. Additionally, weakened end portion 5 is only one means for providing a leader or grip for pulling annular band 2 from container body 3 and screw cap 1.

Figure 3:
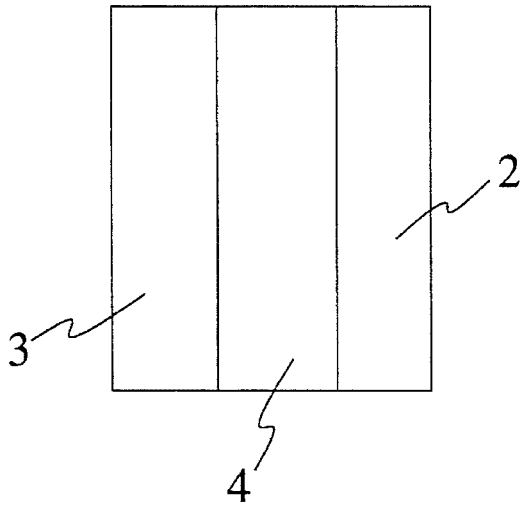
FIG. 3 is a cross-sectional view, taken along line A—A' in FIG. 2, of a fixing element between the band and a container body of FIG. 1.

Referring now also to FIG. 3, fixing element 4 attaches to annular band 2 on one side and to container body 3 on its other side. Fixing element 4 comprises a single layer. However, to adjust the shear required to separate annular band 2 and container body 3, a layer of separation-causing material may be incorporated within fixing element 4 to cause separation to occur within fixing element 4. It is also possible to form a multiple-layer fixing element 4 with a separation-causing material between the layers to obtain a similar result. When fixing element separates internally, part of fixing element 4 remains on container body 3 when annular band 2 is peeled from container body 3. Also, in such case, another pan of fixing element 4 remains on annular band 2 when annular band 2 is peeled.

Unless annular band 2 is cut and removed, screw cap 1 cannot normally be rotated by hand. Therefore, screw cap 1 cannot be removed, or the vacuum broken, without breaking annular band 2 or puncturing screw cap 1. The removal or breaking of annular band 2 reveals tampering or contamination because it cannot be reattached. Thus, the integrity of annular band 2 and/or the integrity of the connection of annular band 2 to screw cap 1 indicates whether container 10 has ever been opened.

It is essential that annular band 2 be required to be separated from screw cap 1 in order to rotate screw cap 1. This is to insure that any rotation of screw cap 1 is revealed by the detachment. For this purpose, annular band 2 is attached to fixing element 4 and fixing element 4 attached, in turn, to container body 3. Thus, annular band 2 is secured to container body 3. To remove annular band 2 from container body 3, one must separate the weakest of the two interfaces. That is, the interface between annular band 2 and fixing element 4 or the interface between fixing element 4 and container body 3 must be separated.

Annular band 2 must be attached to container body 3 to prevent screw cap 1 from being rotated without breaking annular band 2 from screw cap 1. If screw cap 1 could rotated without breaking annular band 2 away from screw cap 1, and if screw cap 1 were replaced, there would be no separation between screw cap 1 and annular band 2 to reveal the opening. Thus, fixing element 4 serves to attach annular band 2 to container body 3 to prevent rotation of screw cap 1 unless annular band 2 is broken, as when screw cap 1 is removed.

The application of a torque to screw cap 1 is resisted by a shear force between annular band 2 and container body 3. The shear force is transmitted from screw cap 1 to annular band 2. The shear force is then transmitted from annular band 2, to fixing element 4 and then to container body 3. Therefore, the shear force must be resisted by the interface between screw cap 1 and annular band 2, that between fixing element 4 and container body 3 and that between fixing element 4 and annular band 2. A shear strength of fixing element 4 or any of the respective interfaces can be characterized by the torque that must be applied to screw cap 1 to break fixing element 4, or shear-separate the interface.

If the shear strength of the interface between fixing element 4 and annular band 2 is smaller than the shear strength of the interface between annular band 2 and screw cap 1, screw cap 1 can be rotated and opened without separating screw cap 1 from annular band 2. In other words, if the torque required to cause shear separation of fixing element 4 from annular band 2 is smaller than the torque required to break annular band 2 at break-line 6, screw cap 1 can be rotated and opened without separating screw cap 1 from annular band 2. The same is true if the torque required to cause shear separation of fixing element 4 from the wall of container body 3 is smaller than the torque required to break annular band 2 at break-line 6. In such cases, when screw cap 1 is screwed back onto container body 3, container 10 appears to be unaltered, giving no indication that it had been opened. The ability of annular band 2 to reveal prior opening of container 10 is entirely lost. Therefore, it is necessary for the shear strengths of the interface between fixing element 4 and annular band 2 and the interface between fixing element 4 and the wall of container body 3 to be greater than the shear strength of the interface between annular band 2 and screw cap 1 at break-line 6. That is:

$$t_p<t_b \text{ and} \quad (1)$$

$$t_p<t_w \quad (2)$$

where $t_p$ is the torque required to break the connection between screw cap 1 and annular band 2, $t_b$ is the torque required to shear-separate annular band 2 and fixing element 4 and $t_w$ is the torque required to shear-separate fixing element 4 and container body 3.

If the torque required to break break-line 6 is too small, fixing element 4 and annular band 2 may remain attached to container body 3 when screw cap 1 is removed. If screw cap 1 is then screwed back onto container body 3, the perforations of perforated line 7 may be lined up, obfuscating the prior opening. Thus, the interface between screw cap 1 and annular band 2 must be strong enough to resist being broken by application of torque to screw cap 1. Since the interface between screw cap 1 and annular band 2 must be stronger than those of the other two interfaces (i.e.,inequalities (1) and (2)), the shear strengths of the other interfaces must also be strong enough to resist being broken by application of torque to screw cap 1. In other words, if the shear strengths of all the interfaces, that between screw cap 1 and annular band 2, that between annular band 2 and fixing element 4 and that between fixing element 4 and container body 3, are greater than that required to resist the torque that can be applied by an ordinary adult, screw cap 1 cannot be opened without great difficulty unless annular band 2 is first removed from screw cap 1 by peel-separation. That is:

$$t_h<t_p, \quad (3)$$

$$t_h<t_w \text{ and} \quad (4)$$

$$t_h<t_b \quad (5)$$

where $t_h$ is the maximum torque that a normal adult male can manually apply to screw cap 1.

As described above, the present invention provides a means for peeling annular band 2 from container body 3 prior to unscrewing screw cap 1. The means permits annular band 2 to be peeled from container body 3 by lifting weakened end portion 5 of annular band 2 and pulling annular band 2 from container body 3. Annular band 2 breaks away from screw cap 1 along series of perforations 7 and peel-separates from container body 3. When annular band 2 is separated from screw cap 1, screw cap 1 can be turned and opened easily. Even if screw cap 1 is replaced, the absence of annular band 2 evidences the prior opening.

For aesthetic reasons, it is desirable for fixing element 4 to remain adhered to annular band 2 and to be removed with annular band 2 as annular band 2 is peeled away from container body 3. Thus, the peel strength of the bond between fixing element 4 and container body 3 should be less than that between fixing element 4 and annular band 2. That is:

$$P_w<P_b \quad (6)$$

where $P_w$ is the peel strength of the interface between fixing element 4 and container body 3 and $P_b$ is the strength of the attachment between fixing element 4 and annular band 2.

The total peeling force required to remove annular band 2 includes the peeling force required to break annular band 2 from screw cap 1. Thus the total peeling force $P_{max}$ required to be applied is:

$$P_{max}=P_w+P_p \quad (7)$$

where $P_p$ is the peeling force required to break annular band 2 from screw cap 1.

The magnitude of $P_p$ affects the total amount of peeling force $P_{max}$ required to remove annular band 2 and screw cap 1 from container body 3. However, the magnitude of $P_p$ does not determine whether fixing element 4 will remain attached to annular band 2 after annular band 2 is peeled from container wall 3. Thus, inequality (6) is sufficient to guarantee that fixing element 4 will remain attached to annular band 2 after it is removed from container body 3 and not left on container body 3.

When $P_w$ is less than $P_b$, the interface between container body 3 and fixing element 4 will separate before enough force can be applied to separate the interface between fixing element 4 and annular band 2. The force applied to break-line 6 with series of perforations 7 is transmitted to screw cap 1 alone and not to the interface between fixing element 4 and container body 3 or the interface between fixing element 4 and annular band 3. Thus, no matter how strong the connection between annular band 2 and screw cap 1, whether fixing element 4 remains attached to container wall 3 after annular band 2 is pulled with a force greater than $P_{max}$ will depend only on $P_w$ relative to $P_b$.

It is a simple matter to form an interface with low peel strength and high shear strength. That is, it is easy to create an interface that can be peeled by applying less force than required to overcome it by application of a shear force. It is desired for the peeling force to be much less than the upper limit of human strength and the shearing torque to be substantially greater than such limit. For example, most adhesives form bonds that are much easier to peel-separate than to shear separate. Thus, interfaces may be formed that satisfy inequalities (3), (4) and (5) and yet also satisfy:

$$P_h > P_w \quad (9)$$

where $P_w$ is the peeling force required to separate the interface between fixing element 4 and container body 3 and $P_h$ is the maximum force that can easily be applied by a normal adult. The peel separation of annular band 2 and screw cap 1 can similarly be made much easier than the corresponding shear separation. A series of perforations would be much easier to peel separate than to shear separate since all of the bridges between the perforations would have to be broken at once in order to shear separate the two components, but only one at a time in order peel separate them. As stated, means other than series of perforations 7 for breaking annular band 2 from screw cap 1 may be employed such as a thin section between annular band 2 and screw cap 1.

In order for annular band 2 to be peel separated, it must be possible to obtain a leader to pull on. One embodiment of the present invention provides weakened end portion 5 which can be separated easily from the rest of annular band 2. As mentioned above, weakened end portion 5 of annular band 2 includes a break or a series of perforations running across annular band 2. Also, weakened end portion 5 remains unattached to container body 3 so that it can be grasped easily. Alternatively, weakened end portion 5 could be broken easily across the width of annular band 2 instead of being provided with a series of perforations. Once weakened end portion 5 is broken, it can be grasped and pulled to remove annular band 2.

It is known from past experiment that the rotational torque that a normal adult can apply to a container cap, such as screw cap 1, is closely related to the diameter D of the cap. It has been confirmed that the range of torques, M' (N·cm), that an normal adult can apply to container 10 to open screw cap 1 of container 10 lies within the range satisfying equation (10):

$$0.4 \cdot D^2 < M' < 1 \cdot D^2 \quad (10)$$

where D is the diameter of screw cap 1 in centimeters. It has also been confirmed by experiment that the torque M beyond that which an ordinary male adult can generate easily by hand is in the range:

$$1 \cdot D^2 < M < 8 \cdot D^2, \quad (11)$$

the lower limit being the upper limit of equation 10. Accordingly, when the maximum torque that can be applied by hand $t_h$ satisfies equation (11), container 10 cannot be opened without removing annular band 2 thereby revealing the opening. Thus, if a torque substantially greater than $1 \cdot D^2$ would have to be applied to screw cap 1, it could be considered virtually impossible to open by hand. It is intended to be understood that inequalities (10) and (11) are not dimensionally accurate and are meant to show only a numerical relationship.

Opening torque M includes a component of torque arising from the opening torque of screw cap 1 absent fixing element 4. Fixing element 4 is connected to annular band 2 and connects a wall of container body 3 to annular band 2. Fixing element 4 should be attached to the wall of container body 3 so that the torque required to detach it is smaller than that required to detach the interface between annular band 2 and fixing element 4 as described above. In addition, this torque should be greater than the torque that an ordinary adult male can apply easily by hand.

Another way to provide for removal of annular band 2 from container body 3 is to provide a multiple-layer type of fixing element 4. When fixing element 4 consists of a single layer, the separable interface between fixing element 4 and the wall of container body 3 is that between the wall of container body 3 and the inward-facing surface of the single layer fixing element 4. If fixing element 4 consists of multiple layers, the separable interface between fixing element 4 and the wall of container body 3 can be the interfaces between layers of fixing element 4. In any case, the separation is a result of separating the weakest of the interfaces.

Ordinarily, it is undesirable for fixing element 4 permanently to fasten annular band 2 to the wall of container body 3. However, if the separable interface lies within fixing element 4, the interface between the wall of container body 3 and fixing element 4 must be permanent. Thus, a layer of fixing element 4 may remain adhered to the wall of container body 3 after annular band 2 is removed and container 10 opened. If the adherent layer is designed appropriately, there will be no adverse effect on the appearance of opened container 10.

Figure 4:
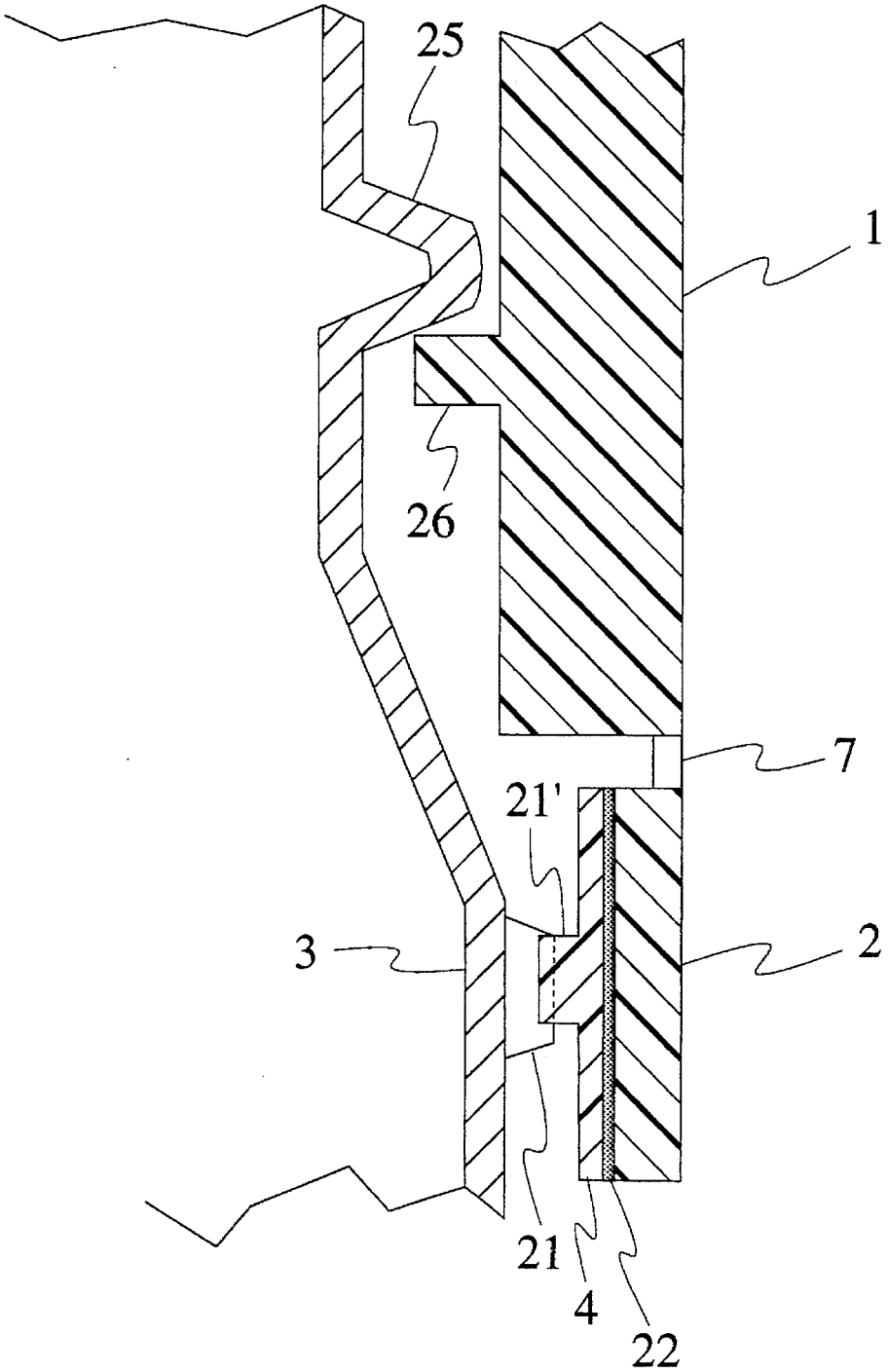
FIG. 4 is a cross-section view of a portion of the screw cap of FIG. 1 screwed on a container body according to an embodiment of the invention.

Referring now to FIG. 4, one means for allowing fixing element 4 to be peeled easily is to not attach fixing element to container body 3. First engaging 21 can be used on container body 3 and second engaging members 21' used on fixing element 4 to resist rotation of fixing element 4 relative to container body 3 when screw cap 1 is rotated. For example, container body 3 may have first engaging members 21' on container body 3 having an edge to engage second engaging member 21' on fixing element 4. Fixing element 4 can be attached to annular band 2. Alternatively fixing element 4 may include an edge (not shown) or a projection (not shown) to engage a projection (not shown) or edge (not shown) on annular band 2. Note that fixing element 4 may encircle container body 3 or cover only a portion of container body 3.

When the separable interface is that between the wall of container body 3 and fixing element 4, it is preferable that fixing element 4 be secured impermanently by an adhesive agent. This is because permanent adhesion by a strong adhesive agent prevents annular band 2 from being separated from container body 3, in turn preventing connecting portion 6 from being broken by peeling annular band 2 away from screw cap 1. It is preferable for the adhesive agent to adhere impermanently to the wall of container body 3, but very tenaciously to annular band 2. This will insure that the adhesive is removed together with fixing element 4 and annular band 2 and not remain on container body 3. This prevents the adhesive from marring the appearance of container body 3 after screw cap 1 is removed. A hot-melt type of adhesive of the same material as annular band 2 may be used to achieve this result and is desirable.

If no fixing element 4 lies between weakened end portion 5 and the wall of container body 3, peeling annular band 2 from container body 3 will be easier. This is because weakened end portion 5 is unattached and thereby easier to lift away from container body 3. On the other hand, it is preferable for fixing element 4 to secure an end of annular band 2 opposite weakened end portion 5 to container body 3.

Opening Test

A screw cap 1 having annular band 2 and series of perforations 7 as shown in FIG. 2 was made of polypropylene. A polypropylene hot-melt adhesive agent was applied beforehand to part of the inside of annular band 2. Annular band 2 and screw cap 1 were screwed onto a threaded cylinder similar to that of container body 3. The cylinder opening had an outer diameter of 70 mm, a diameter suitable for container body 3. The temperature of the cylinder was raised to about 110 ÛCby high frequency heating from the outside of annular band 2 causing the hot-melt adhesive agent to fuse. The cylinder and annular band 2 were then cooled. The cylinder was stood with the capped end down and a metal screw cap like screw cap 1 was screwed twice around the other end of the cylinder. A vacuum pump pulled a vacuum of approximately 60 cm Hg to simulate sealed container 10 with a vacuum inside.

The cylinder was connected to a TNK-120 torque meter (Shinpo Kogyo Co.), and polypropylene screw cap 1 unscrewed. Torque was measured as torque, applied to screw cap 1, was increased until screw cap 1 was unsealed, thereby breaking the vacuum.

When screw cap 1 was rotated directly without pulling annular band 2 off, the vacuum-breaking torque was more than 90 N·cm because the torque had to overcome and break the hot-melt adhesive portion to rotate screw cap 1. When annular band 2 was peeled off beforehand, the torque required to unseal screw cap 1 and break the vacuum was 30 to 35 N·cm. The shape of screw cap 1 before and after opening was greatly altered by removing annular band 2, which was a satisfactory indication that screw cap 1 had been unsealed.

Comparative Example

Screw cap 1 having annular band 2 and series of perforations 7 as shown in FIG. 2 was made of polypropylene. Screw cap 1 had a fin-shaped projection on the inside of annular band 2. Screw cap 1 was screwed onto a threaded cylinder. The cylinder opening had an outer diameter of 70 mm. The cylinder had a ratchet-like projection to engage the fin-shaped projection. The cylinder was stood with the capped end down and a metal cap was screwed twice around the other end of the cylinder and fastened by a vacuum fastener which pulled a vacuum of approximately 60 cm Hg to simulate sealed container 10 with a vacuum inside.

The cylinder was connected to a TNK-120 torque meter (Shinpo Kogyo Co.), and polypropylene screw cap 1 unscrewed. Torque was measured as sufficient torque was applied to unseal screw cap 1, breaking the vacuum. The vacuum-breaking torque was found to be 35 to 40 kg/cm. Thus, it was relatively easy to unseal the cylinder without entirely removing screw cap I from annular band 2. Screw cap 1 could not be removed before the fin of annular band 2 caught the ratchet-like projection of the cylinder. However, screw cap 1 had to be substantially elevated by the screw in order to separate annular band 2 from screw cap 1. The fracture torque for breaking annular band 2 away from screw cap 1 was approximately 110 N·cm. This torque is too high to be normally opened by a consumer. However, because the vacuum is broken before annular band 2 is broken away from screw cap 1, this type of arrangement cannot give notice of a prior unsealing of a container.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A tamper-revealing container, comprising:

a screw cap having first threads;

a container body having a wall and a mouth;

said mouth having second threads shaped to thread with said first threads;

said screw cap being threadable on said container body;

an annular band attached to a lower end of said screw cap;

a fixing element;

means for attaching said fixing element to said annular band;

said fixing element, with said annular band attached thereto, surrounding, at least partly, said container body;

means for resisting a rotation of said fixing element around said container body, said means for resisting being separate from said attaching means;

said means for resisting having a shear strength characterized by a first torque;

said first torque being a first force applied to said fixing element to defeat said means for resisting;

means for permitting peeling said annular band and said fixing element from said screw cap and said wall; a second force required peeling said band; and said first force being greater than said second force.

2. A container as in claim 1, wherein:

said means for resisting includes a projection on one of said container body and said fixing element and an edge on an other of said container body and said fixing element; and said edge positioned on said other to engage said projection when said fixing element is rotated.

3. A container as in claim 1, further comprising:

means for attaching said fixing element to said wall;

said means for attaching said fixing element to said annular band having a first peel strength;

said means for attaching said fixing element to said wall having a second peel strength; and said first peel strength being substantially greater than said second peel strength.

4. A container as in claim 3 wherein:

said means for attaching said fixing element to said annular band includes a first adhesive; and said means for attaching said fixing element to said wall includes a second adhesive.

5. A container as in claim 1 wherein:

said means for permitting peeling includes a break line between said annular band and said screw cap; and said break line including one of a first series of perforations and a thin-walled section of one of said annular band and said screw cap.

6. A container as in claim 5 wherein said means for permitting peeling includes:

a weakened end portion of said annular band;

said annular band having a lower edge;

said weakened end portion extending at least part way across said annular band between said lower edge and said break line; and said weakened end portion including one of a thin-walled section, a second series of perforations and a break in said annular band.

7. A container as in claim 6 wherein a portion of said annular band adjacent to said weakened end portion is unattached to said fixing element.

8. A container as in claim 6 wherein a portion of said fixing element adjacent to said weakened end portion of said annular band is unattached to said wall.

9. A tamper-revealing container, comprising:

a container body having a mouth;

a screw cap having a diameter;

said screw cap being screwed onto said container body;

an annular band attached to a lower end of said screw cap;

said annular band having a dividing region;

said dividing region having means for permitting said annular band to be torn from said screw cap when a peeling force is applied to said lower portion;

said means for permitting including a portion of said annular band which is weaker than a remainder of said annular band;

a fixing element;

a first bond means for impermanently attaching said fixing element to said container body, at said mouth;

said first bond means having a first shear strength defined by a first torque;

said first torque being a first minimum torque required to shear-separate said fixing element from said container body by rotating said fixing element relative to said container body;

a second bond means for attaching said fixing element to said annular band;

said second bond means having a second shear strength defined by a second torque;

said second torque being a second minimum torque required to shear-separate said fixing element from said annular band by rotating said annular band relative to said fixing element;

said dividing region having a third shear strength defined by a third torque;

said third torque being a third minimum torque required to break said annular band at said dividing region by rotating said screw cap relative to said lower portion;

a fourth torque, in Newton·centimeters, being equal in magnitude to a square of said diameter in centimeters;

said first torque being substantially greater than said fourth torque;

said second torque being substantially greater than said fourth torque;

said third torque being substantially greater than said fourth torque;

said first torque being substantially greater than said third torque; and said second torque being substantially greater than said third torque.

10. A container as in claim 9, wherein:

said first bond means has a first peel strength;

said second bond means has a second peel strength; and said second peel strength is substantially greater than said first peel strength.

11. A container as in claim 9, wherein:

said first bond means has a first peel strength;

said second bond means has a second peel strength; and said fixing element includes a plurality of layers;

said fixing element includes an inter-layer bond between a first and second of said plurality having a third peel strength;

said first peel strength being substantially greater than said third peel strength; and said second peel strength being substantially greater than said third peel strength.

12. A container as in claim 9, wherein said dividing region includes one of a first series of perforations and a thin-walled section.

13. A container as in claim 9, further comprising:

a weakened portion of said lower portion;

said lower portion having a lower edge opposite said dividing region;

said weakened portion having an end extending from said dividing region to said lower edge;

said end being defined by one of a thin-walled section, a second series of perforations and a break in said lower portion;

said weakened portion having an inward-facing surface; and said inward-facing surface being unattached to said container.

14. A tamper-revealing container, comprising:

a screw cap;

a container body;

said screw cap being screwed onto said container body;

said screw cap having an integral band around a perimeter of said screw cap;

means for detaching said band from said screw cap by peeling said band;

a fixing element;

first adhesive means for attaching said fixing element to said band;

second adhesive means for attaching said fixing element to said container body;

said means for detaching including means for resisting a rotation of said screw cap relative to said container body; and a first rotational force required to overcome said means for resisting;

a second force that is required to peel said band from said screw cap;

said first rotational force being greater than said second force.

15. A container as in claim 14, wherein:

said first adhesive means has a shear strength which can be overcome by application of a first torque to said band;

said second adhesive means has a shear strength which can be overcome by application of a second torque to said band; and said first torque is less than said second torque.

16. A container as in claim 14, wherein said means for detaching includes one of a series of perforations and a thin-walled section between said band and said screw cap.

17. A container as in claim 14, wherein:

said first adhesive means has a first peel strength;

said second adhesive means has a second peel strength; and said first peel strength is substantially less than said second peel strength.

18. A container as in claim 14, wherein:

said fixing element includes a plurality of layers;

said fixing element includes means for bonding two of said plurality;

said means for bonding has a third peel strength;

said third peel strength is substantially less than said first peel strength; and said third peel strength is substantially less than said second peel strength.

19. A tamper-revealing container, comprising:

a screw cap having a diameter and a perimeter;

a container body;

said screw cap being screwed onto said container body;

said screw cap having a band around said perimeter;

means for detaching said band from said screw cap while said screw cap is screwed onto said container body;

a fixing element;

first adhesive means for attaching said fixing element to said band;

second adhesive means for attaching said fixing element to said container body;

said means for detaching including means for resisting a rotation of said screw cap;

a first force being required to remove said detaching means;

a second force being required to unscrew said screw cap while said detaching means is attached to said screw cap;

said second force being greater than said first force;

a first torque in, Newton·centimeters, required to overcome said means for resisting;

a number, T, equal to a square of said diameter expressed in centimeters;

a second torque having a magnitude of T Newton·centimeters; and said first torque being substantially greater than said second torque.

20. A container as in claim 19, wherein:

said first adhesive means has a shear strength which can be overcome by application of a first torque to said band;

said second adhesive means has a shear strength which can be overcome by application of a second torque to said band; and said first torque is less than said second torque.

21. A container as in claim 19, wherein:

said band is integral with said screw cap; and said means for detaching includes one of a series of perforations and a thin-walled section between said band and said screw cap.

22. A container as in claim 19, wherein:

said first adhesive means has a first peel strength;

said second adhesive means has a second peel strength; and said first peel strength is less than said second peel strength.

23. A container as in claim 19, wherein:

said fixing element includes a plurality of layers;

said fixing element includes means for bonding two of said plurality;

said means for bonding has a third peel strength;

said third peel strength is less than said first peel strength; and said third peel strength is less than said second peel strength.

* * * * *

UNITED STATES PATENT AND TRADEMARK OFFICE

CERTIFICATE OF CORRECTION

PATENT NO. : 5,467,880

DATED : November 21, 1995

INVENTOR(S) : Makoto ETOH and Kiyoshi KAWAGUCHI

It is certified that an error appears in the above-identified patent and that said Letters Patent is hereby corrected as shown below:

Column 4, line 39, change "pan" to --part--.

Column 8, line 23, after "fixing element" insert --4--;

line 24, after "engaging" insert --members--;

line 29, change "21'" to --21--;

line 30, change "member" to --members.

Column 9, line 5, change "110 ÛCby" to --110°C by--;

line 45, change "breaking" to --to break--;

line 48, change "I" to --1--.

Signed and Sealed this

Twenty-sixth Day of August, 1997

*Attest:*

Bruce Lehman

BRUCE LEHMAN

*Attesting Officer*

*Commissioner of Patents and Trademarks*